US005657880A

United States Patent [19]

Birnbaum

[11] Patent Number: 5,657,880

[45] Date of Patent: Aug. 19, 1997

[54] MODULAR CONSTRUCTED MARKETING AND SALES BIN CONTAINER AND ORGANIZER

[76] Inventor: Alan H. Birnbaum, 5474 Newcastle Ave., No. A-205, Encino, Calif. 91316

[21] Appl. No.: 404,974

[22] Filed: Mar. 16, 1995

Related U.S. Application Data

[63] Continuation-in-part of Ser. No. 14,202, Oct. 15, 1993.

[51] Int. Cl.[6] ..... B42F 17/00

[52] U.S. Cl. ..... 211/50; 211/55; 211/11; 211/126.2

[58] Field of Search ..... 211/11, 50, 52, 211/55, 126, 128, 194; 206/425, 503, 504; D19/92, 87

[56] References Cited

U.S. PATENT DOCUMENTS

| | | | |
|---|---|---|---|
| D. 290,059 | 5/1987 | Kirchner | D19/92 X |
| 698,350 | 4/1902 | Anderson | 211/50 |
| 717,247 | 12/1902 | McCaskey | 211/50 X |
| 1,458,953 | 6/1923 | Robeson | 211/50 X |
| 1,575,696 | 3/1926 | La Selle | 211/50 X |
| 1,951,972 | 3/1934 | Fraser | 211/126 |
| 2,684,766 | 7/1954 | Blom | 211/55 |
| 4,074,810 | 2/1978 | Juergens et al. | 211/11 |
| 4,480,745 | 11/1984 | Loge et al. | 211/126 X |
| 4,700,829 | 10/1987 | Goodyear | 211/11 X |
| 4,785,939 | 11/1988 | Huerto et al. | 211/11 X |
| 4,955,677 | 9/1990 | Song | 211/55 X |

*Primary Examiner*—Ramon O. Ramirez
*Assistant Examiner*—Sandra Snapp
*Attorney, Agent, or Firm*—Thomas A. Turner, Jr.

[57] ABSTRACT

A modular container provides a first bin having a compartment for holding general shaped objects and a second compartment for holding vertically a pad of paper in the longitudinal dimension relative to the first compartment. The container includes a slidable printing surface extending from and recessing into said first bin while being prevented from complete removal. A second modular bin is removably attachable to the first bin without covering the compartment of the first bin for vertically holding a pad of paper, and is positionable in a plurality of selectable positions.

10 Claims, 5 Drawing Sheets

MODULAR CONSTRUCTED MARKETING AND SALES BIN CONTAINER AND ORGANIZER

CONTINUATION-IN-PART APPLICATION

This application is a Continuation-in-Part Application of my co-pending application Ser. No. 14,202 filed Oct. 15, 1993 in my name and my name only as inventor for "BIN." Priority of all subject matter common to said patent application Ser. No. 14,202 and this Application is hereby claimed.

DESCRIPTION OF THE PRIOR ART

1. Field of the Invention

This invention relates to the art of containers, and more particularly to the art of modular, constructable bins for displaying and selling objects along with instructional printed material.

2. Description of the Prior Art

In the past, containers in the form of bins have been provided for holding objects on a desk, counter or like surface. Bins in a variety of shapes have been taught which are capable of holding papers, pencils, printed material and objects such as pills, tablets, capsules, granulated material, paper clip, fasteners and the like. Such containers are called variously desk organizers, holders, trays and other descriptive names. One such organizer is shown and taught in Letters Patent No. 4,991,712 to Wagner. Another such holder is shown in Design Letters Patent No. 261,583 to Labasan. Additional examples of such containers may be seen in Design Letters Patent No. 295,540 to Rabig and Design Letters Patent No. 317,178 to Kheng. These showings are typical in having front and rear walls and parallel side walls, each of varying heights from a floor to make access from the front and sides more easy for the fingers of a person. All of such teachings have certain structural attributes that satisfy certain desires and in many instances requirements for organizing and holding objects of varying shapes and sizes for ready access to users.

Although modular components for building a desired container may be known, it has been desired to provide a container having varying sized compartments for holding pills, capsules and chemical compound tablets while also holding printed paper material, all for ready access to a user, and which can be assembled by attaching together modules in a final configuration that most easily fits on a counter, desk or like surface within other objects which may limit and defined an awkward space available for such a container. It is also desired to provide such a container that, notwithstanding normal configurations of the various modular components, the pills and printed material will be readily accessible. It is also desired to provide such a container which has integrally formed with it, access to instructions, limitations and warnings associated with the pills, etc. being held and made available to a user.

SUMMARY

In brief, in accordance with one aspect of the present invention, a container has a first bin with a compartment for holding pills, capsules and like objects, and with an integral compartment for holding paper on the edges thereof, where the paper is easily contacted by the fingers on the side of the paper and moved through the front of the container. Other objects may be held by additional compartments within the bin. Further, non-removable instructional material may be slidably held and positioned for ready access.

A second bin is constructed for fitting onto said first bin in one of a multiple of configurations by flanges extending from the side of the second bin. The flanges are formed to fit within holes in the first bin, so that the first and the second bins remained a structurally connected unit. The assembly is formed so that multiple choices may be made in adapting the container to selected space.

Other novel features which are believed to be characteristic of the invention, both as to organization and methods of operation, together with further objects and advantages thereof, will be better understood from the following description in which preferred embodiments of the invention are described byway of example.

DESCRIPTION OF THE PREFERRED EMBODIMENT

Figure 2:
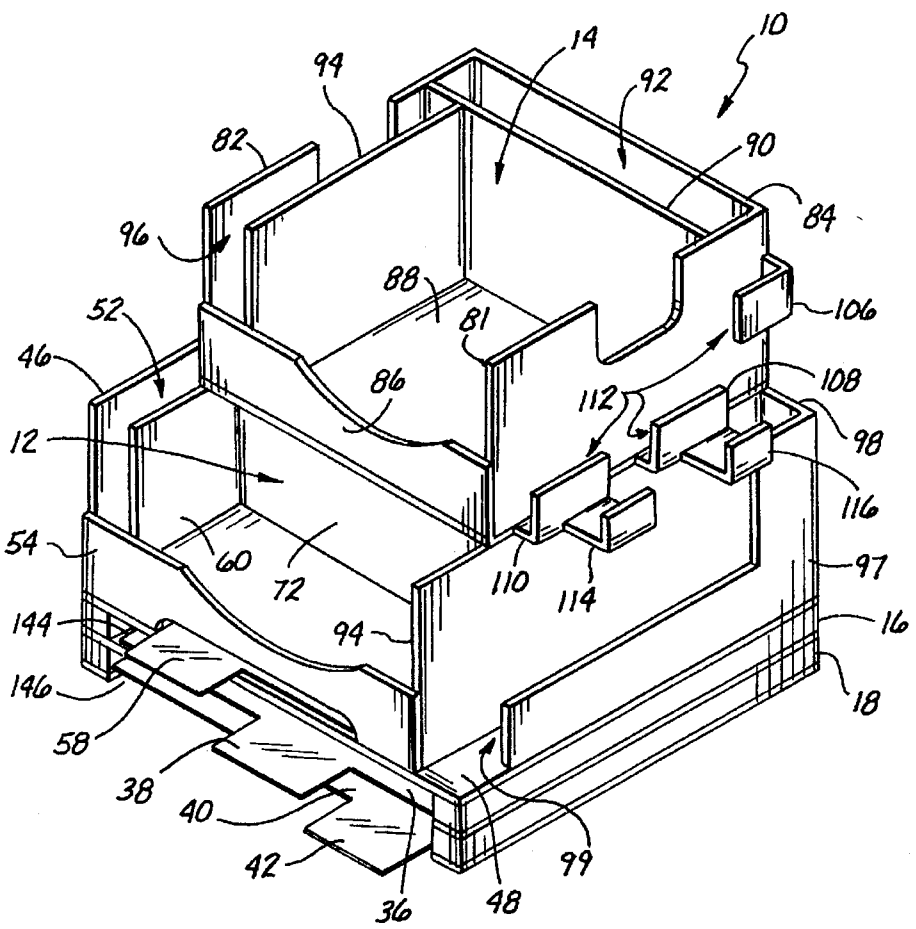
FIG. 2 is a perspective view of the preferred embodiment of the invention taken from a different view.
Figure 1:
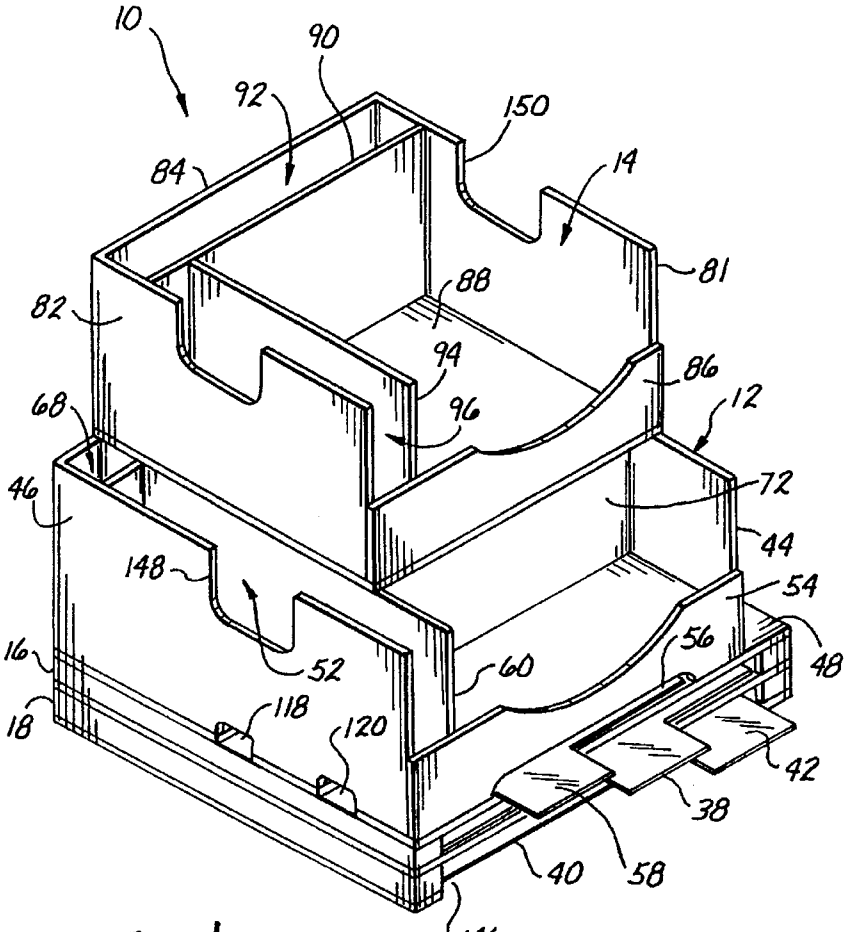
FIG. 1 is perspective view of the preferred embodiment of the invention.

The preferred embodiment of the present invention is shown in two different views of perspective in FIGS. 1 and 2 of the accompanying drawings where a bin assembly or container 10 comprises a first or main bin 12, and a second or auxiliary bin 14. The container 10 also comprises a first or upper tray 16 and a second or lower tray 18 attached to the first or main bin 12 so that the first bin 12 sits on top of the two trays 16, 18. The trays 16, 18 each comprise a separate module which can be detached from the first bin 12.

Figure 3:
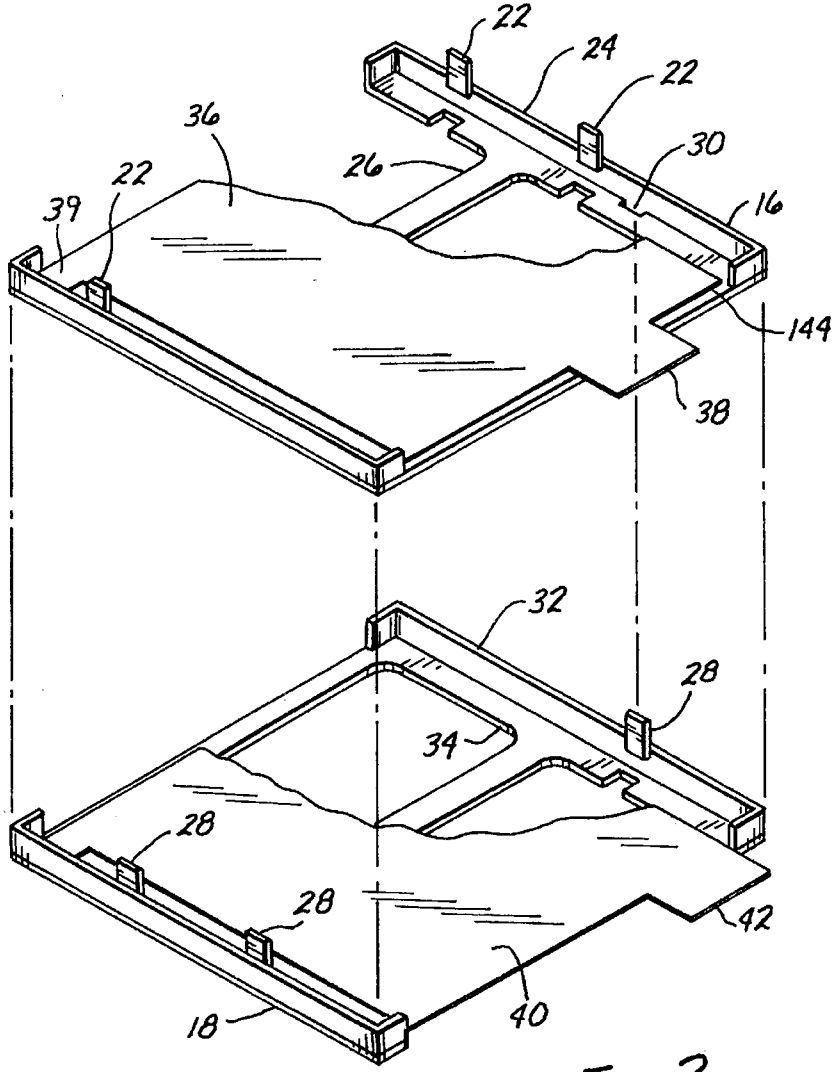
FIG. 3 is a perspective view of a portion of the preferred embodiment of the present invention, showing component parts of the configuration exploded for ease in understanding.

In FIG. 3, the attachment of the trays 16, 18 to the first bin 12 can be better understood, where the first bin 12 is shown exploded from the trays 16, 18. The upper tray 16 has a plurality of dowels 22 extending upwardly from the sides 24 of the tray 16. The sides 24 of the tray 16 are formed together with the frame-type floor or bottom 26, all as may be better seen in FIG. 8, which be described in greater detail below. The lower tray 18 has dowels 28 which are formed and positioned to fit through corresponding holes 30 formed and carefully positioned in the upper tray 16. The dowels 28 of the lower tray 18 extend upwardly from the sides 32 formed on the lower tray 18. The sides 32 of the lower tray 18 are formed with a frame-type bottom 34. When the upper tray 16 is placed on top of the lower tray 18 so that its dowels 28 fit through the corresponding holes 30 of the upper tray 16, the upper tray 16 is attached to the lower tray 18.

A sliding card or sliding insert 36 is formed in a shape that includes a tab 38 and flanges 39. The sliding card 36 is placed within the upper tray 16. A similar card 40 is placed in the lower tray 18. Card 40 has a tab 42 normally protruding from the tray 18 so that it can be seen when the card 40 is slidably recessed within tray 18.

Figure 5:
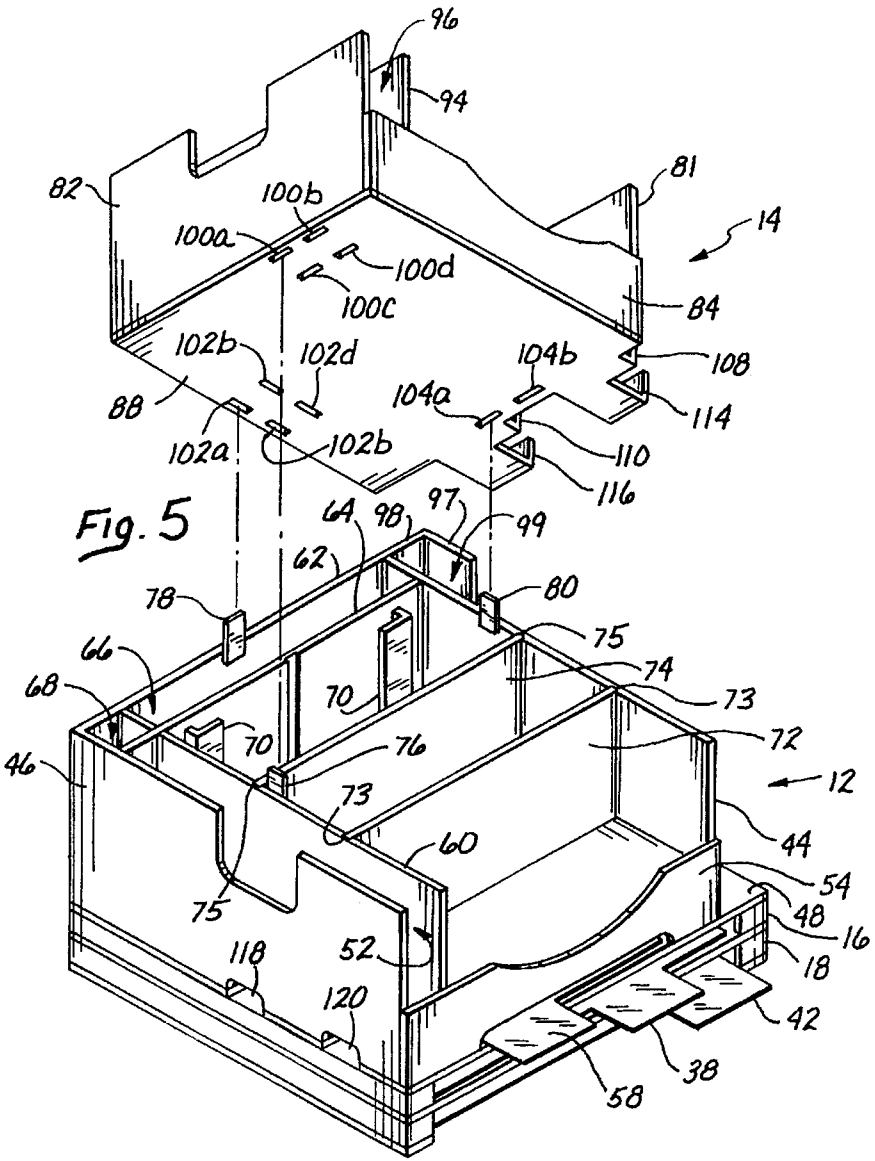
FIG. 5 is a perspective view of modules of the preferred embodiment of the present invention, having a module exploded from the container for ease in understanding.
Figure 4:
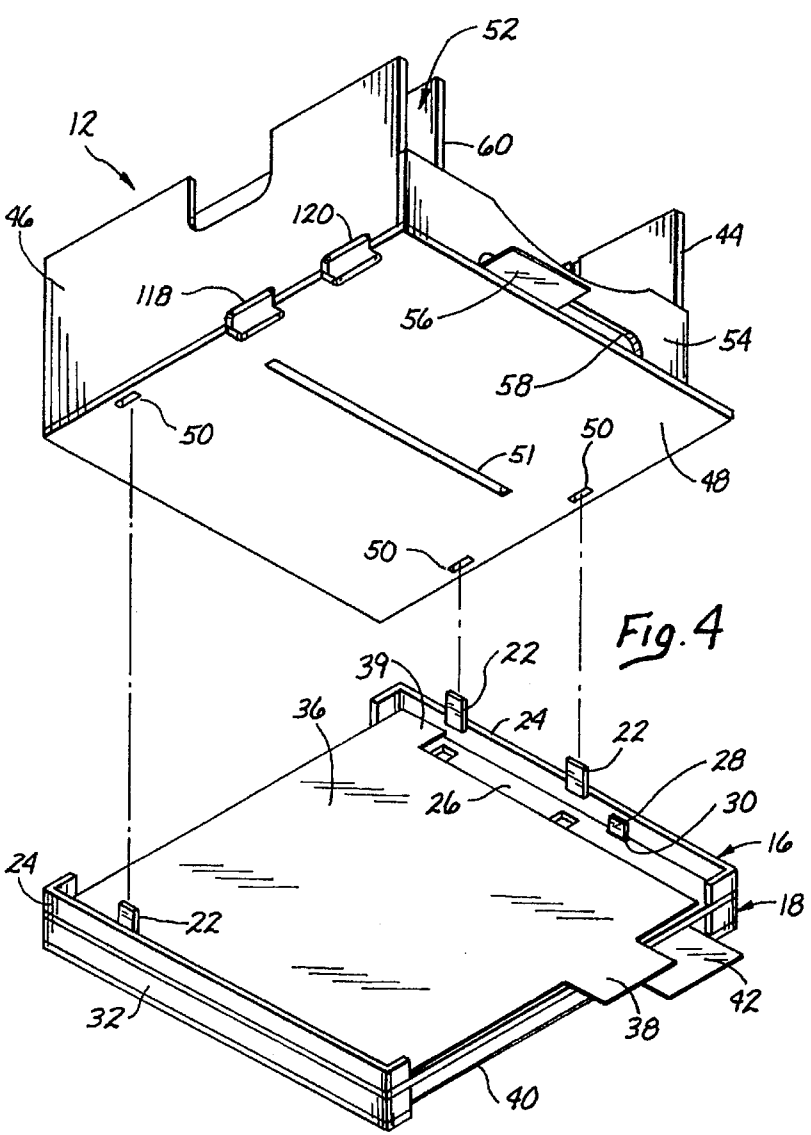
FIG. 4 is a perspective view of further components of the preferred embodiment of the present invention, having such components shown exploded for ease in understanding.

As better seen in FIGS. 4 and 5, the first bin 12 has a first side wall 44 and a second side wall 46 which are generally parallel to each other and are formed from the front of the bin 12 to the rear of the bin 12. For ease of description, the dimension from the front to the rear of the bin 12 will be designated the longitudinal dimension here in this specification. The first bin 12 has a bottom 48 in which are formed carefully positioned holes 50. The holes are positioned to receive the dowels 22 of the upper tray 16 when it is selected to attach the first bin 12 to the upper tray 16, as shown in FIGS. 1 and 2. A bottom aperture 51 is formed in the bottom 48 of the first bin 12.

As may be best seen in FIG. 5, the front of the bin 12 is fitted with a third or front wall 54 which extends across part, but not all of the front of the first bin 12, between the first wall 44 and the second wall 46. The front wall 54 has an opening 56 through which a tab 58 of yet another card is seen protruding. Another compartment 52 is formed in the first bin 12 between wall 60 and the second wall 46. A fourth wall 62 extends substantially all the way across the rear or back of the bin 12. Running between the first wall 44 and the second wall 46 a little offset from the back or fourth wall 62 is a rear partition 64, which defines a rear compartment 66 and a smaller, corner compartment 68. Compartment 68 might be useful for holding pencils and like elongated objects upright. In addition, vertical slots 70 are formed on the rear partition 64, for holding calling cards.

Still as best seen in FIG. 5, the first bin 12 is provided with a removable front divider 72 which can be slid vertically into place between slots or slotted guide 73. In similar manner, a rear divider 74 can be removably positioned vertically by sliding the divider 74 in slotted guide or slots 75. In keeping with the concept of options available with the modular structure of the present invention, either or both of these dividers 72, 74 can be removed at the option of the user, in order to make different sizes for the compartments within the first bin 12.

A dowel 76 is formed to extend upwardly from the partition wall 60. In like manner, dowel 78 extends upwardly from the back or fourth wall 62 of the bin 12. Dowel 80 extends upwardly in like manner from the first, side wall 44. These dowels are positioned to extent into holes formed in the floor of the auxiliary bin 14, as will be explained in greater detail below.

The second bin 14 is provided with a first or side wall 81 and a second or side wall 82 substantially parallel to each other. A third or rear wall 84 extends between the first and the second walls 81, 82 across the back or rear of the bin 14. A fourth or front wall 86 extends across the front of the bin 14 between the first and second walls 81, 82. All walls 81, 82, 84, 86 extend upwardly from the floor 88 of the auxiliary bin 14. The front wall 86 extends upwardly from the floor 88 to a height less than the other, first three walls 81, 82, 84 of the bin 14, allowing easier access to a hand entering from the front.

In the auxiliary bin 14, a rear partition 90 extends upwardly from the floor 88 and extends between the first and second side walls 81, 82 to define a compartment 92. Another partition 94 extends upwardly from the floor 88 longitudinally from the front wall 86 to the rear partition 90 to define compartment 96.

As best seen in FIG. 2, the first bin 12 has fifth wall 97 extending longitudinally from the front to the rear which is generally parallel to the first side wall 44. A sixth wall 98 extends upwardly from the bottom 48 of the bin 12 between the rear of the fifth wall 97 and the rear of the first wall 44, and might be seen as an extension of the back wall 62. A compartment 99 is defined by the first, fifth and sixth walls 44, 97, 98 that can hold papers, cards and like printed material or blank writing pads on their edges. Significantly, the fifth wall 97 has a surface area that is substantially less than the surface area of the first wall 44, to allow fingers of a hand to engage the papers that are retained and stored within the compartment 99. The front of the compartment 99 is open, further, so that the stored papers can be easily slid forward, without obstruction, by the fingers, and removed for use by a user.

The positioning of the second bin 14 in relation to the first bin 12 is capable of several selectable configurations at the option of the user, as may be appreciated by FIG. 5 of the drawings. Holes 100, 102, 104 are formed in the floor 88 of the bin 14 to receive the dowels 76, 78, 80 formed on the first bin 12. The set of holes 100 comprises a first hole **100*a*, a second hole 100*b*, a third hole, 100*c* and a fourth hole 100*d*. Each of these holes 100 are formed to receive dowel 76, but it may readily be appreciated that the position of bin 14 with bin 12 when the two are attached to each will be different for each of the holes 100*a*, 100*b*, 100*c*, 100*d*. Similarly, the set of holes 102 comprises a first hole 102*a*, a second hole 102*b*, a third hole 102*c* and a fourth hole 102*d*. Each of these holes 102*a*, 102*b*, 102*c*, 102*d* is formed to receive the dowel 78 of the first bin 12. When the dowel 76 is inserted into the hole 100*a*, the dowel 78 should comfortably fit into hole 102*a*. Similarly, when the dowel 76 is inserted into hole 100*b*, the dowel 78 should fit comfortably into hole 102*b*. Continuing, when the dowel 76 is fitted into hole 100*c*, the dowel 78 should fit comfortably into hole 102*c*. Likewise, when the dowel 76 is fitted into hole 100*d*, the dowel 78 should fit into hole 102*d***.

The set of holes 104 comprises a first hole **104*a* and a second hole 104*b*. There are no holes corresponding to holes 100*c* and 100*d*, or to holes 102*a* and 102*b*, for such holes would be beyond the side edge of floor 88. When the dowel 76 is fitted into hole 100*a* and the dowel 78 is fitted into hole 102*a*, the dowel 80 should fit comfortably into hole 104*a*. Similarly, when the dowel 76 is fitted into hole 100*b* , and dowel 78 is fitted into hole 102*b*, dowel 80 will fit into hole 104*b*. When the dowel 76 is fitted into either 100*c* or 100*d*, and when the dowel 78 is fitted into hole 102*c* or 102*d*, the dowel 80 will be beyond the floor 88**.

It may be appreciated that by positioning the dowels 76, 78, 80 into selected ones of the corresponding holes 100, 102, 104, the relative position of the bin 14 with respect to the first bin 12 can be changed in one of four selectable configurations. By such positioning, various of the compartments 52, 66, 68 and the main compartment of the bin 12 can be made more, or less accessible.

As best seen in FIG. 2, the upper, auxiliary bin 14 is further formed to have a series of L-shaped flanges extending from its first wall 81 to provide a channel for holding papers, cards and like printed material or blank writing pads on their edges. L-shaped flange 106 extends from the rear of the first wall 81. L-shaped flange 108 extends from the lower edge of first wall 81, almost as an extension of the floor 88. Similarly, L-shaped flange 110 extends from the lower edge of the floor 88, all to form a channel 112 for holding thin material on the edges thereof. It may be seen from the view of FIG. 2, that thin, paper-like material held in the channel 112 can be accessed easily by fingers of the hand, and can be slid forwardly or upwardly to be removed for use, and returned to the channel 112 for storage later.

As may be best seen in FIG. 2, but also in FIG. 5, the L-shaped flanges are extended further to form additional L-shaped flanges 114, 116. In particular, L-shaped flange 114 extends further than flange 110 from the floor 88. In parallel, a second L-shaped flange 116 extends further from the floor 88 from the L-shaped flange 108. Complementally, holes 118, 120 are formed in the first or main bin 12, as better seen in FIG. 1, but also in FIGS. 4 and 6. In particular, the L-shaped flange 114 is formed to fit into the hole 120, while the L-shaped flange 116 is formed to fit into hole 118, reference now being had to FIG. 9.

Figure 10:
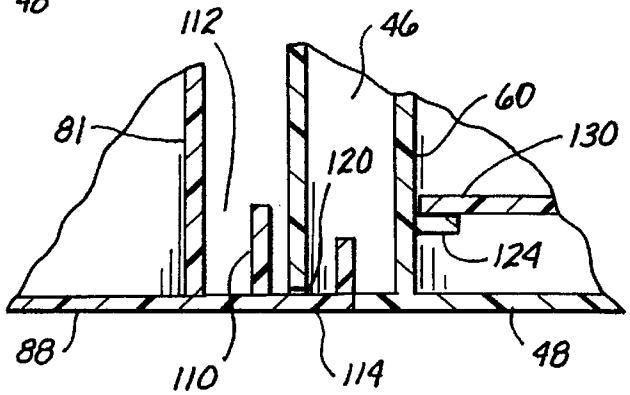
Figure 9:
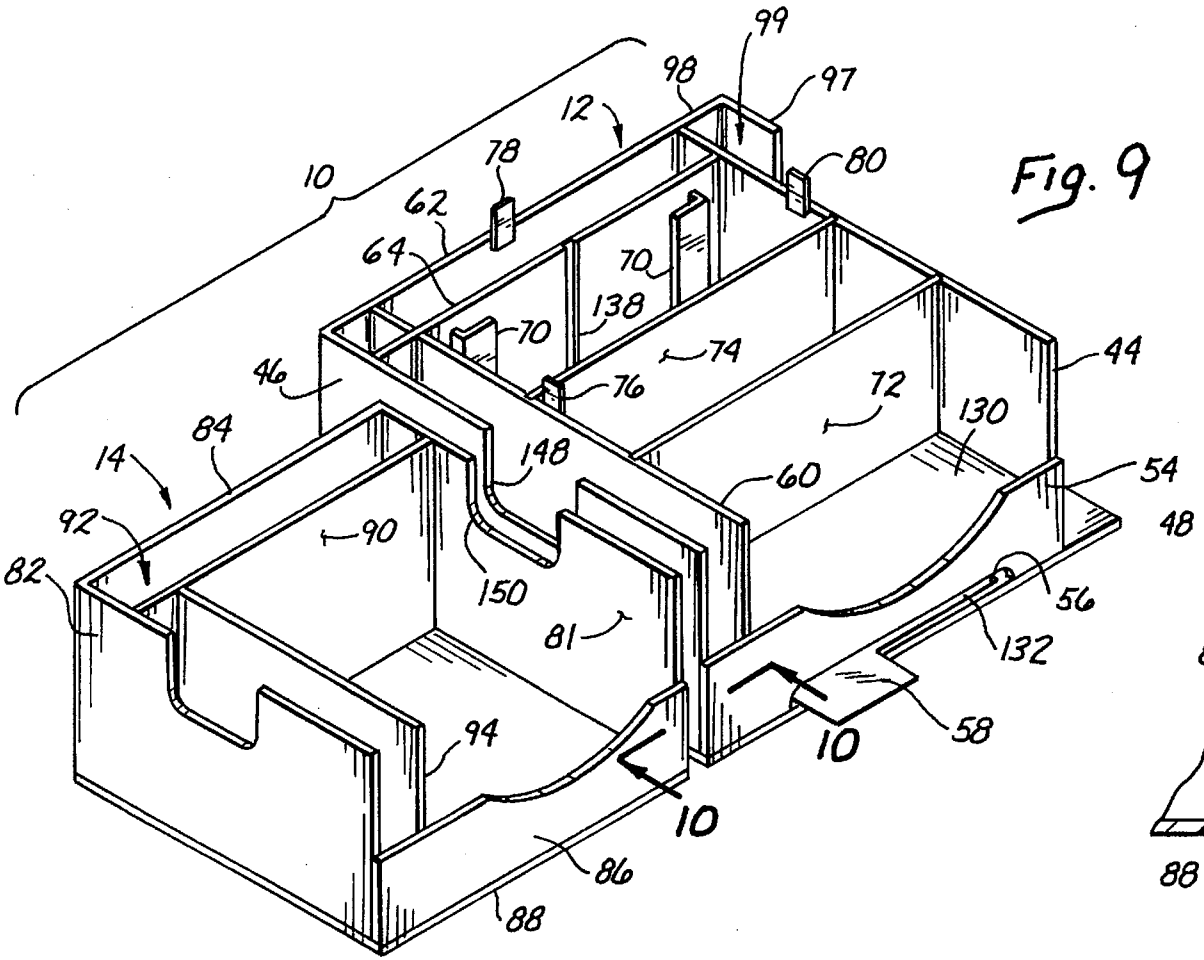
FIG. 9 is a perspective view of an alternative configuration of the preferred embodiment of the present invention; and, FIG. 10 is a side elevation, partial cross-sectional view of a portion of the alternative configuration taken along line 10—10 of FIG. 9.

In FIG. 9, an alternative configuration having the auxiliary bin 14 postioned laterally adjacent to the main bin 12 is shown. The auxiliary bin 14 is attached to the main bin 12 by hooking the L-shaped flanges 114, 116 into corresponding holes 120, 118, as seen in FIG. 10, a partial cross-section elevation view taken along line 10—10 in FIG. 9. As may be appreciated, the notch or removed portion 148 of the second side wall 46 of the main bin 12, and the notch or removed portion 150 of the first side wall 81 of the auxiliary bin 14 align, so that thin material stored in the channel 112 can be grasped by fingers of the hand readily for removing and returning material to the channel 112. In such an alternative assembly 10, the trays 16, 18 normally are removed from the assembly 10, so that the floor 88 of the auxiliary bin 14 and the bottom 48 of the main bin 12 are on the same plane, that is, rest on the same surface. Of course, if the auxiliary bin 14 is made to rest on some sructure elevating it in relation to the main bin 12, the trays 16, 18 might be kept in the assembly 10 when the auxiliary bin 14 and the main bin 12 are attached in the manner of FIG. 9.

Figure 8:
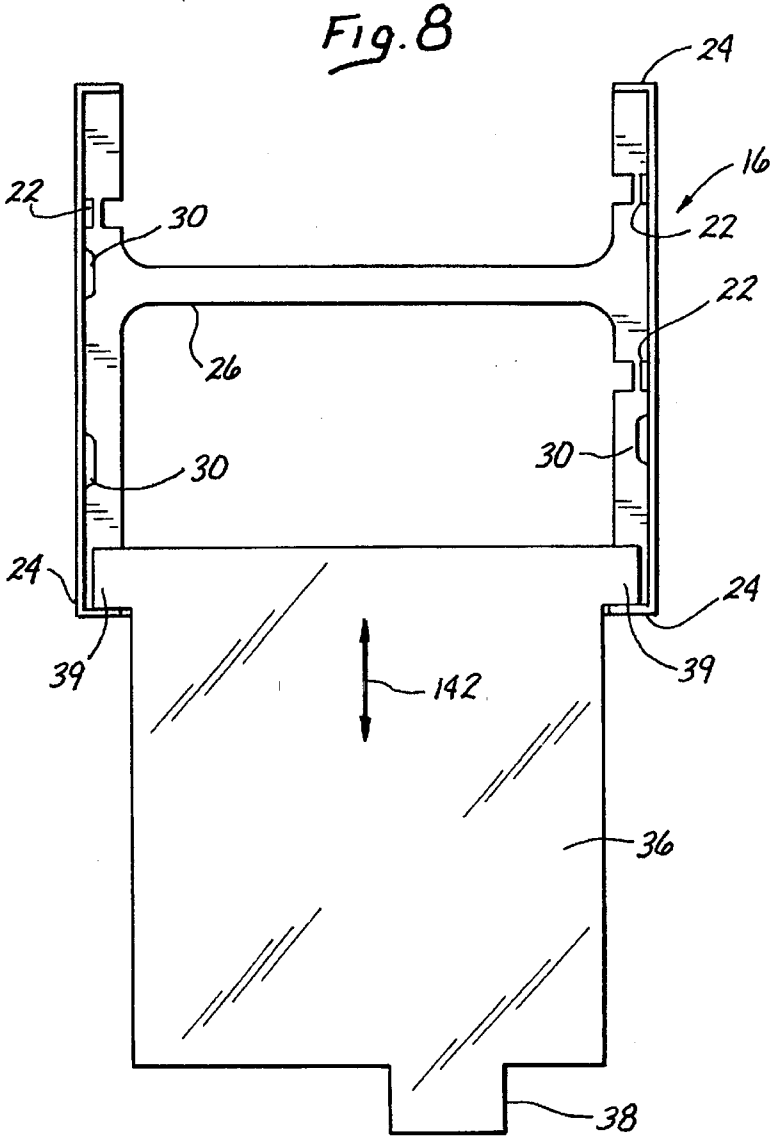
FIG. 8 is a top view of a modular component of the preferred embodiment of the present invention, showing a printed card extended.
Figure 7:
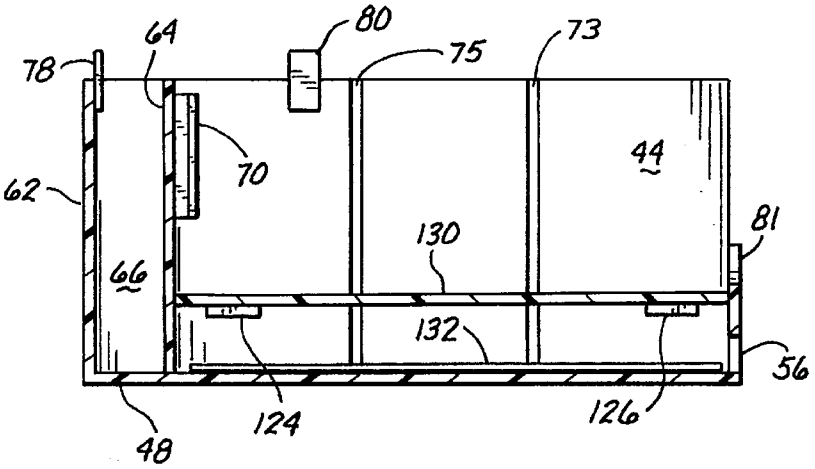
FIG. 7 is cross-sectional view of a portion of the preferred embodiment of the present invention, taken along line 7—7 of FIG. 6.
Figure 6:
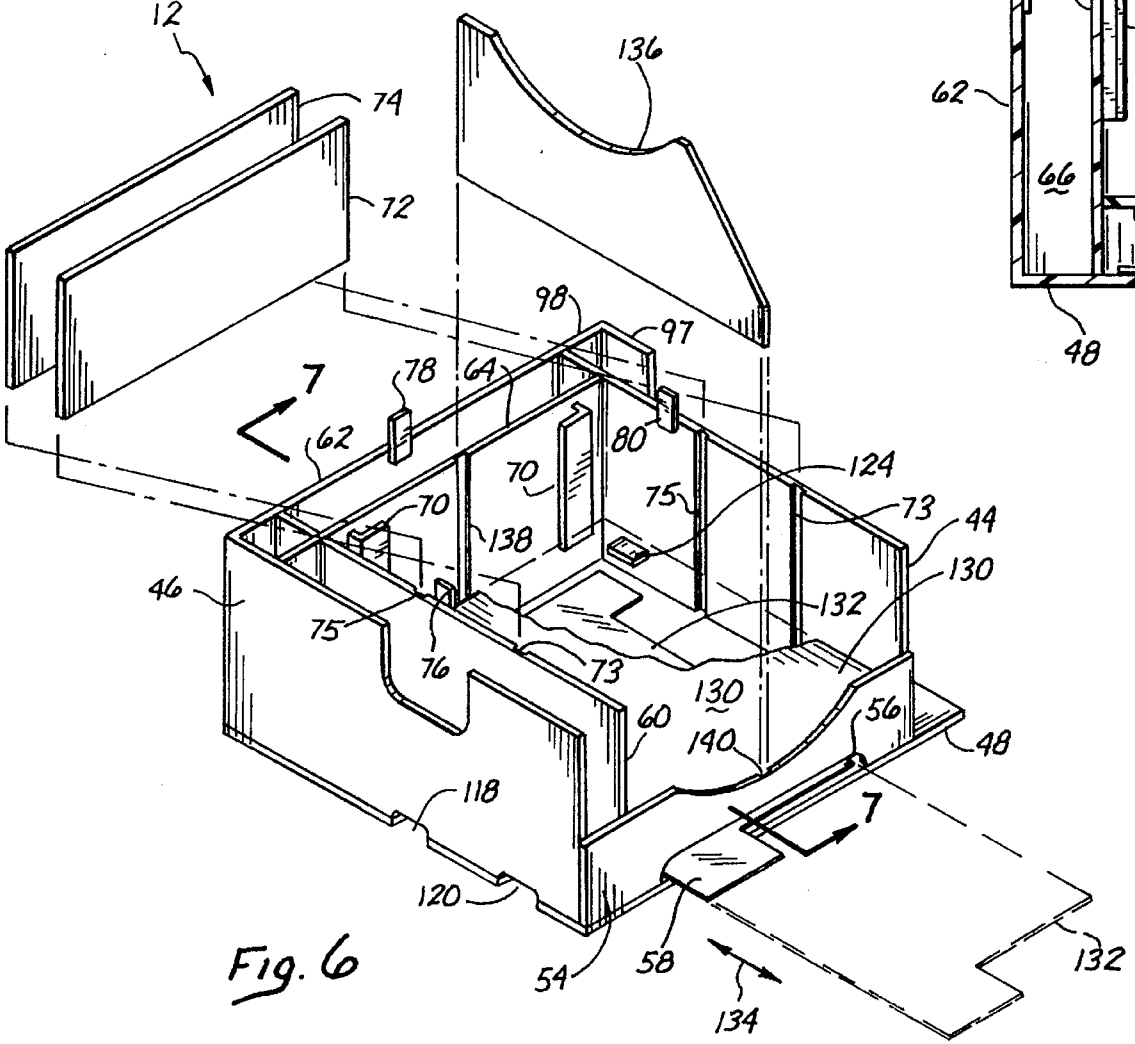
FIG. 6 is a perspective view of a portion of the preferred embodiment of the present invention having certain alternative parts thereof exploded for clarity in description.

In FIG. 6, and in FIG. 7 which is a cross-section of FIG. 6 taken along line 7—7 of FIG. 6, the main bin 12 is shown with a false floor 130 which has as its purpose the incorporation of a slidable insert in a similar manner as the slidable inserts 36, 40 for the trays 16, 18 described in detail above. Knobs or flanges 124, 126 protrude inwardly from the first side wall 44 and the partition side wall 60 at the same height or level within the main compartment of the main bin 12. The main bin floor 130 then rests on these flanges 124, 126. The main bin floor 130 extends from the front wall 54 to the rear partition 64, and from the first side wall 44 to the partition wall 60, to cover and make a floor for the main compartment of the main bin 12. Between the main bin floor 130 and the bottom 48 of the main bin 12 is a space in which rests a slidable insert 132 on which printed instructions and information can be placed. The insert 132 has the tab 58 described above, which is visible substantially at all times. The tab 58 can be used to extend the insert 132 through the hole or opening 56 in the direction of the arrow 134 to make the printed information on the insert 132 visible to the user. The insert can then be recessed through the hole 56 back into the space between the main bin floor 130 and the main bin bottom 48. The insert 132 might be prevented from being entirely removed from the assembly 10, such as by flanges on rear as is representatively shown for the insert 36 (FIG. 8). If such a flange is a part of the insert 132, the insert 132 can be removed entirely from the assembly through the bottom aperture 51 formed in the bottom 48 of the main bin 12. The bottom aperture 51 is formed sufficiently wide so that the insert 132 can be passed through it.

In FIG. 6, further, alternative positions for dividers are shown for the main compartment of the main bin 12. As described above, the dividers 72, 74 can be inserted into the slots or guides 75 and/or 73, and as easily can be removed to make the main compartment configured as desired. In addition, another alternative configuration can be made by inserting the divider 136 in a longitudinal direction in the slots or guides 138 on the rear partition 64 and 140 on the inside of the front wall 54.

In FIG. 8, the operation of the inserts 36, 40 is illustrated when it is desired to have the trays 16, 18 part of the assembly 10. The operation of the insert 36 in the first or upper tray 16 is shown as representative for itself and the insert 40 of the second or lower tray 18, as well. The insert 36 may be extended in the direction of the arrow 142 out through the opening 144 in the front of the tray 16 resulting from the side 24 of the tray 16 being extended slightly around to cover a small portion of the front from both longitudinal sides of the tray 16, as shown. The insert 36 is prevented from being completely removed by the flanges 39 on the rear of the insert 36, which engage the side 24 extended around on the front from both longitudinal sides of the tray 36. A similar opening 146 is provided in the front of the tray 18, as also may be seen in FIGS. 1 and 2.

In operation, the assembly can be configured in several optional ways, in accord with the desires of the user. In one configuration, the trays 16, 18 may be stacked upon each other by inserting the dowels 28 of the lower tray 18 through the holes 30 of the upper tray 16. The sides 32 of the lower tray 18 will sustain the upper tray 16 a spaced distanced from the frame-type bottom 34 of lower tray 18 and result in the opening 146. In a like manner, the main bin 12 is stacked upon the upper tray 16 by inserting the dowels 22 of the upper tray 16 through the holes 50 formed in the bottom 48 of the main bin 12. The sides 24 of the upper tray 16 will sustain the main bin 12 a spaced distance from the frame-type bottom 26 of the upper tray 16, resulting the opening 144. The insert 36 of the upper tray 16, and the inset 40 of the lower tray 18 can be pulled by their corresponding, exposed tabs 38, 42 to extend the inserts 36, 40 as far as desired or until their corresponding flanges 39 prevent further removal by being engaged by the front portion of the sides 24, 32, as described above. The inserts 36, 40 can be recessed within the assembly 10 by pushing on the tabs 38, 42. It is envisaged that, if the bins 12, 14 are to be used for storing medicinal pills and medications, one of the inserts 36 will have dosing information printed thereon, while the other insert 40 may have warning and side effect information printed thereon.

The main bin 12 also has an insert 132 which can be extended and recessed in the directions of arrow 134. Insert 132 might have suggested or recommended applications imprinted thereon. The dividers 72, 74 may be made part of the configuration in order to make more, but smaller compartments within the main bin 12, or both or either of the dividers 72, 74 may be removed to make compartment space in the main bin 12 as desired. Alternatively, both dividers 72, 74 may be removed and the longitudinal divider 136 may be installed within the guides or slots 138, 140 to provide for two longitudinally shaped compartments within the main bin 12.

The auxiliary bin 14 in the assembly 10 may be attached on the top edges of the main bin 12, by inserting the dowels 76, 78, 80 through a selected one of a set of corresponding holes 100, 102, 104, corresponding to each of the dowels 76, 78, 80 formed in the floor 88 of the auxiliary bin 14. If the dowels 76, 78, 80 are inserted into corresponding holes 100*a*, 102*a*, 104*a* the position of the auxiliary bin 14 in relation to the main bin 12 will be slightly forward and to the right, when facing the front of the assembly 10. For clarity in the following description, this position may be considered an "original" position in the relationship of the auxiliary bin 14 to the main bin 12. By selecting to insert the dowels 76, 78, 80 into the corresponding holes 100*b*, 102*b*, 104*b*, the auxiliary bin 14 will be positioned slightly to the rear of the original position described immediately preceding. By selecting to insert the dowels 76, 78 into corresponding holes 100*c*, 102*c*, with the dowel 80 not being inserted but hanging free, as it were, the auxiliary bin 14 will be positioned slightly to the left of the original relationship with main bin 12. A fourth selection is to insert the dowels 76, 78 into corresponding holes 100*d*, 102*d* and to have the dowel 80 hang free, in which selection the position of the auxiliary bin 14 will be slightly to the left and to the rear of the original position in its relationship with the main bin 12.

Alternatively, the auxiliary bin 14 may be configured by attaching it to the side of the main bin 12. The L-shaped flanges 114, 116 extending from the first side wall 81 of the auxiliary bin 14 are insert in corresponding holes 120, 118 formed in the second side wall and bottom 48 of the main bin 12. This configuration leaves the channel 112 fully capable of storing thin material along the side of the auxiliary bin 14, and readily accessible to fingers of the hand, especially through the notches or removed portions 148, 150 of the adjacent walls 46, 81.

Further, thin material, such as paper, pads, cards and the like may be stored and readily accessed along the side of the main bin 12 in a channel 99. Because the surface area of the wall 97 is substantially less than the surface of the first wall 44, the fingers of the hand can engage by friction the stored material, and slide it forwardly which is formed without obstruction in the front of the main bin 12.

The foregoing description of my invention and of preferred embodiments as to products, compositions and processes is illustrative of specific embodiments only. It is to be understood, however, that additional embodiments may be perceived by those skilled in the art. The embodiments described herein, together with those additional embodiments, are considered to be within the scope of the present invention.

I claim:

1. A container for organizing product materials, comprising:

a) a first bin having at least a floor having a front, a rear and a longitudinal dimension defined from said front to said rear;

b) a first compartment within said first bin defined by at least a first, a second, a third and a fourth walls extending substantially upward from said floor, said first and said second walls being oriented in the longitudinal dimension, and said fourth wall being positioned across said front of said bin between said first and said second walls; and, c) a second compartment within said first bin substantially defined by said first and a fifth and a sixth walls extending substantially upward from said floor, said fifth wall being positioned substantially parallel to said first wall and oriented in said longitudinal dimension, and the front of the bin between said first and said fifth walls being substantially open from said floor upwards, said second compartment adapted for holding between said fifth and said first walls, paper vertically on edges of said paper, and wherein said first and said fifth walls each having surface areas, said fifth wall having substantially less surface area than said first wall providing ready access through said fifth wall to said paper held vertically between said first and said fifth walls.

2. The container of claim 1 further comprising a third compartment within said first bin defined by said second and a seventh and an eighth walls extending substantially upward from said floor, said seventh wall being positioned parallel to said second wall.

3. The container of claim 1 further comprising a first slidable printing surface means slidably connected to said first bin for containing print information thereon and for slidably extending from and recessing into said container, said container further comprising means connected to said first slidable printing surface means for preventing removal of said first slidable printing surface means from said container when said printing surface is slidably extending therefrom.

4. The container of claim 3 further comprising a second slidable printing surface means slidably connected to said first slidable printing surface means for containing print information thereon and for slidably extending from and recessing into said container, said container further comprising means connected to said second slidable printing surface means for preventing removal of said second slidable printing surface means from said container when said second printing surface is slidably extending therefrom.

5. The container of claim 1 further comprising a third slidable printing surface means slidably connected to said second slidable printing surface means for containing print information thereon and for slidably extending from and recessing into said container, said container further comprising means connected to said third slidable printing surface means for preventing removal of said third slidable printing surface means from said container when said third printing surface is slidably extending therefrom.

6. The container of claim 1 further comprising, in combination with said first bin, a second bin removably connected to said first bin, said second bin having:

a) at least a floor having a front, rear and a longitudinal dimension defined from said front to said rear;

b) a first compartment defined by at least a first, a second and a third walls extending substantially upward from said floor, said first wall being oriented in the longitudinal dimension; and, c) tab and opening means for removably combining said second bin onto said first bin, said second bin being positioned so that at least said second compartment of said first bin is not covered completely by said second bin.

7. The container of claim 6 wherein said tab and opening means bin comprises at least one tab positioned extending upwardly from at least one of the walls of said first bin, and further comprises a plurality of openings formed on the floor of said second bin, each of said plurality of openings adapted to receive said at least one tab, each of said openings when receiving said at least one tab defining a distinct position of said second bin in structural relation to said first bin.

8. The container of claim 6 wherein said at least one tab comprises a flange-like extension extending perpendicularly outwardly from one of said walls of said second bin oriented in the longitudinal dimension.

9. A container for organizing product materials comprising:

a) a first bin having at least a floor having a front, a rear and a longitudinal dimension defined from said front to said rear;

b) a first compartment within said first bin defined by at least a first, a second, a third and a fourth walls extending substantially upward from said floor, said first and said second walls being oriented in the longitudinal dimension, and said fourth wall being positioned across said front of said bin between said first and said second walls; and, c) a first slidable printing surface means slidably connected to said first bin beneath said floor, for containing print information thereon and for slidably extending from and recessing into said container, said container further comprising means connected to said first slidable printing surface means-for preventing removal of said first slidable printing surface means from said container when said printing surface is slidably extending therefrom.

10. The container of claim 9 further comprising a second slidable printing surface means slidably connected to said first slidable printing surface means for containing print information thereon and for slidably extending from and recessing into said container, said container further comprising means connected to said second slidable printing surface means for preventing removal of said second slidable printing surface means from said container when said second printing surface is slidably extending therefrom.

* * * * *